US005916086A

United States Patent [19]

Rossdeutscher

[11] Patent Number: 5,916,086

[45] Date of Patent: Jun. 29, 1999

[54] BED SYSTEM

[76] Inventor: Ralph H. Rossdeutscher, 6 Landsdowne Road North, Cambridge, Canada, N3H 4V6

[21] Appl. No.: 08/607,991

[22] Filed: Mar. 4, 1996

[51] Int. Cl.[6] ..... A47C 23/06

[52] U.S. Cl. ..... 5/236.1; 5/613; 5/618

[58] Field of Search ..... 5/236.1, 238, 617, 5/618, 613

[56] References Cited

U.S. PATENT DOCUMENTS

| | | | |
|---|---|---|---|
| 41,526 | 2/1864 | Merrill | 5/618 |
| 56,211 | 7/1866 | Guyer | 5/618 |
| 1,922,104 | 8/1933 | Lukens | 5/618 |
| 2,606,329 | 8/1952 | Connally | 5/238 |
| 2,702,909 | 3/1955 | Atkins | 5/617 |
| 4,103,170 | 7/1978 | Spradlin | 5/620 |
| 4,477,935 | 10/1984 | Griffin | 5/236.1 |
| 4,573,226 | 3/1986 | Wittmann et al. | 5/236.1 |
| 4,809,375 | 3/1989 | Bull | 5/465 |
| 4,827,544 | 5/1989 | Hüsler | 5/236.1 |
| 4,893,365 | 1/1990 | Justice | 5/618 |
| 5,038,429 | 8/1991 | Elmalek et al. | 5/236.1 |
| 5,233,709 | 8/1993 | Horry | 5/236.1 |
| 5,280,658 | 1/1994 | Sigl | 5/236.1 |
| 5,524,307 | 6/1996 | Griffin | 5/236.1 |
| 5,553,338 | 9/1996 | Amann | 5/236.1 |

FOREIGN PATENT DOCUMENTS

| | | | |
|---|---|---|---|
| 385121 | 11/1993 | European Pat. Off. | 5/236.1 |
| 3406935 | 7/1985 | Germany | 5/236.1 |
| 3905879 | 8/1990 | Germany | 5/236.1 |

*Primary Examiner*—Steven N. Meyers
*Assistant Examiner*—Tuyet-Phuong Pham
*Attorney, Agent, or Firm*—R. Craig Armstrong

[57] ABSTRACT

The bed system has a rectangular frame, with a mattress assembly mounted on the frame. The mattress assembly has upper and lower wooden strip layers and intervening foam blocks. Each wooden strip layer has a plurality of relatively thin, somewhat flexible laterally-oriented wooden strips arranged in proximity to each other from top to bottom of the frame, with each strip extending from one side panel to the other side panel. There are three foam blocks, namely two outer foam blocks and one central foam block, running from head to foot of the bed between the wooden strip layers. A padded layer, preferably of foam approximately 5 cm thick, is positioned on top of the mattress assembly, extending substantially across the full width and length of the mattress assembly. Preferably positioned on top of the padded layer is a sheep's wool mattress pad, also with a cotton cover. Conventional sheets can be used to cover the mattress assembly, padded layer, and mattress pad. A sheep's wool duvet and sheep's wool pillow are preferably used to complete the bed system. The side panels have inwardly-facing shoulder portions running the length thereof, and the wooden strips of the lower wooden strip layer rest on the shoulder portions, with the outer foam blocks being in general vertical alignment with the outer walls of the side panels. Preferably the bed system includes at least one elevating mechanism to permit the head of the bed and/or lumbar and leg portions to be raised. In double, queen or king sized versions of the invention, a central support member runs longitudinally between the head and foot panels, with support rails on either side thereof. Two of the mattress assemblies are arranged side by side, one on either side of the central support member.

14 Claims, 18 Drawing Sheets

BED SYSTEM

BACKGROUND OF THE INVENTION

This invention relates to bed systems, and in particular to a combination of a bed frame with a mattress assembly comprising multiple wooden slats and foam elements, as will be described later herein.

Bed systems of the same general type as in the invention are not new. There presently exist, primarily in Europe, systems which involve similar wooden slat and foam arrangements, although such systems are not adapted to use in North America, where bed frames are generally constructed on quite a different principle.

SUMMARY OF THE INVENTION

It is an object of the invention to provide a bed system which is somewhat similar to the above-mentioned European systems, but which is adapted in unique fashion to the North American type of bed frame.

It is an object, further to the above, to thereby provide a bed system which offers excellent comfort and which may offer therapeutic benefits for some users, particularly those with back trouble.

There are two principal versions of the invention, namely a single bed version, and a version which may be used for double, queen or king size configurations.

In the single bed version of the invention, the bed system has a rectangular frame defined by four vertically-oriented panels, namely a head panel, a foot panel and two side panels. A mattress assembly is mounted on the frame, the mattress assembly having upper and lower wooden strip layers and intervening foam blocks. Each wooden strip layer has a plurality of relatively thin, somewhat flexible laterally-oriented wooden strips arranged in proximity to each other from top to bottom of the frame, with each strip extending from one side panel to the other side panel. There are three foam blocks, namely two outer foam blocks, one adjacent each side panel and running the length thereof, and one central foam block located centrally between the side panels and running from head to foot of the bed between the wooden strip layers. A padded layer, preferably of foam approximately 5 cm thick, and preferably enclosed by a 100% cotton cover, is positioned on top of the mattress assembly, extending substantially across the full width and length of the mattress assembly. Preferably positioned on top of the padded layer is a sheep's wool mattress pad, also with a cotton cover. Conventional sheets can be used to cover the mattress assembly, padded layer, and mattress pad. A sheep's wool duvet and sheep's wool pillow are preferably used to complete the bed system. The side panels have inwardly-facing shoulder portions running the length thereof, and the wooden strips of the lower wooden strip layer rest on the shoulder portions, with the outer foam blocks being in general vertical alignment with the outer walls of the side panels. Therefore, when the frame is constructed to fit on a standard bed frame support, the bed system conforms generally to standard mattress dimensions for the standard bed frame support, thereby avoiding any need for non-standard sheets and other bedding material.

The outer ends of the wooden strips preferably are positioned in pockets provided in material strips along the outer foam blocks, preferably provided in material covers which surround the foam blocks.

Preferably the bed system includes elevating means pivotally mounted between the side panels, pivotable between lowered positions where the mattress assembly is not elevated above the frame, and at least one elevated position where at least a portion of the mattress assembly is elevated above the frame. This permits the person using the bed to raise a portion of the mattress assembly in the person's lumbar region, for example, and/or to provide for the upper portion of the bed to be elevated towards a sitting position and/or the lower portion of the bed to be elevated in the area of the person's legs.

In the double, queen or king sized version of the invention, the identical principles are employed, but there is a central support member running longitudinally between the head and foot panels, centrally between the side panels, with an upper surface at the same height as upper surfaces of the side panels. Two of the mattress assemblies are arranged side by side. The central support member has support rails on either side thereof running the length thereof, so that the individual mattress assemblies are supported in essentially identical fashion as in the single bed version.

Further features of the invention will be described or will become apparent in the course of the following detailed description. In the description, "head" will be used to refer to the end of the bed where the person's head would be located, and "foot" will be used to refer to the end of the bed where the person's feet would be located.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
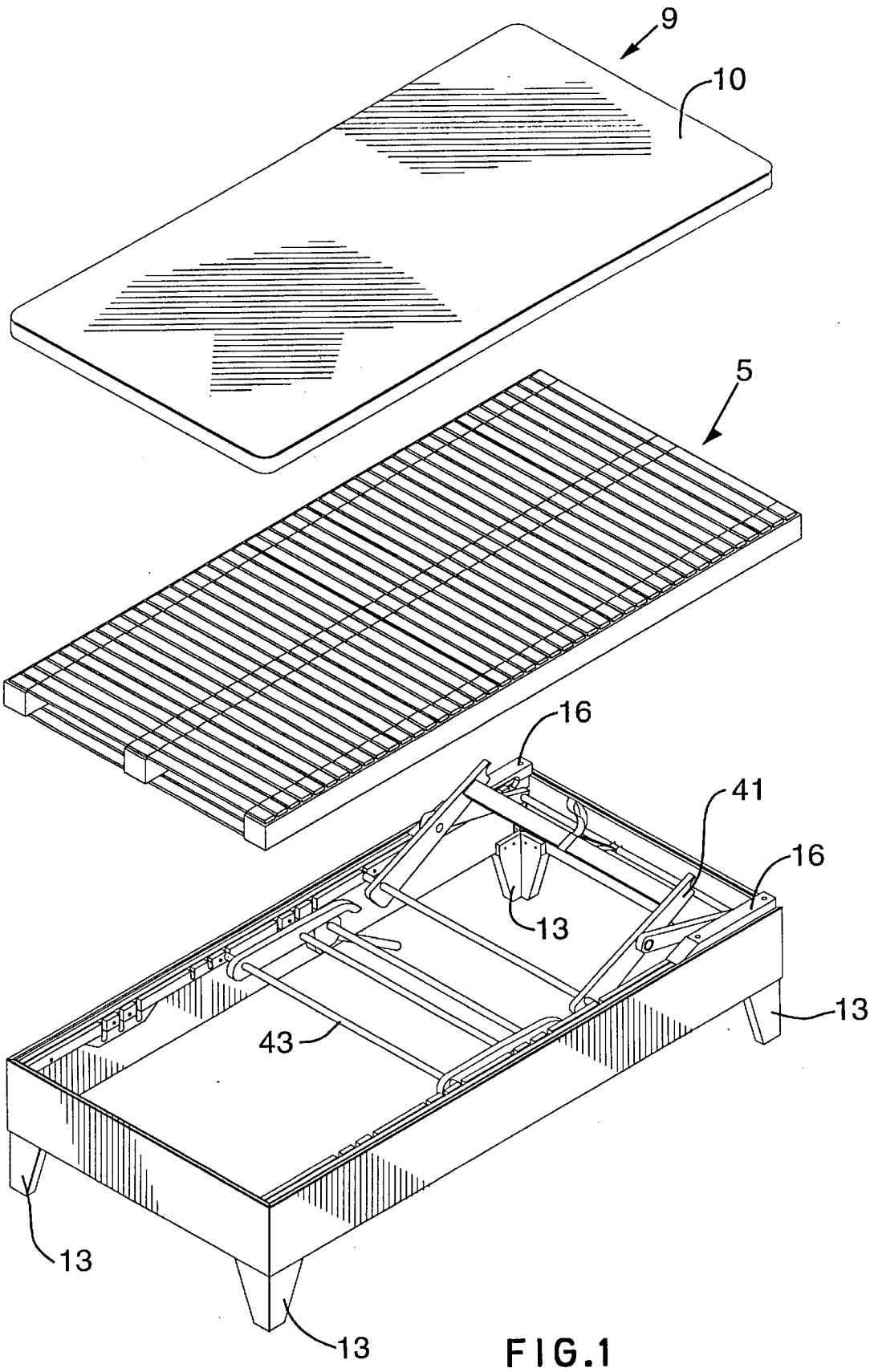
FIG. 1 is an exploded perspective view of the preferred embodiment, in a single bed version.
Figure 2:
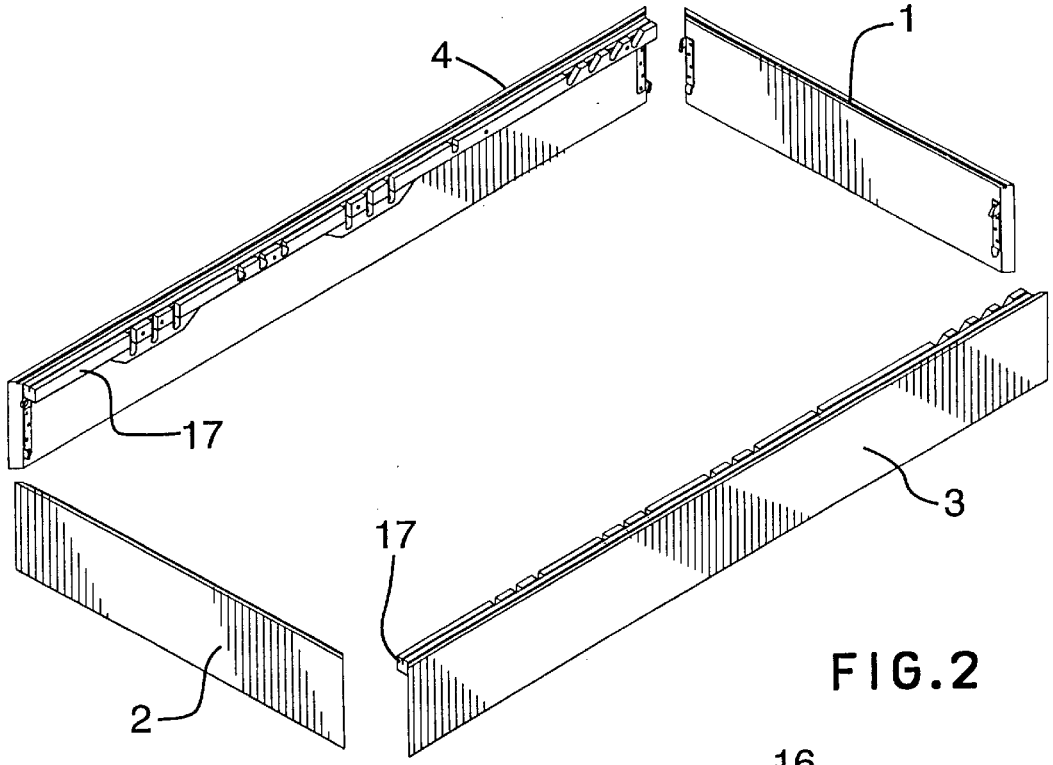
FIG. 2 is an exploded perspective view of the bed frame.
Figure 3:
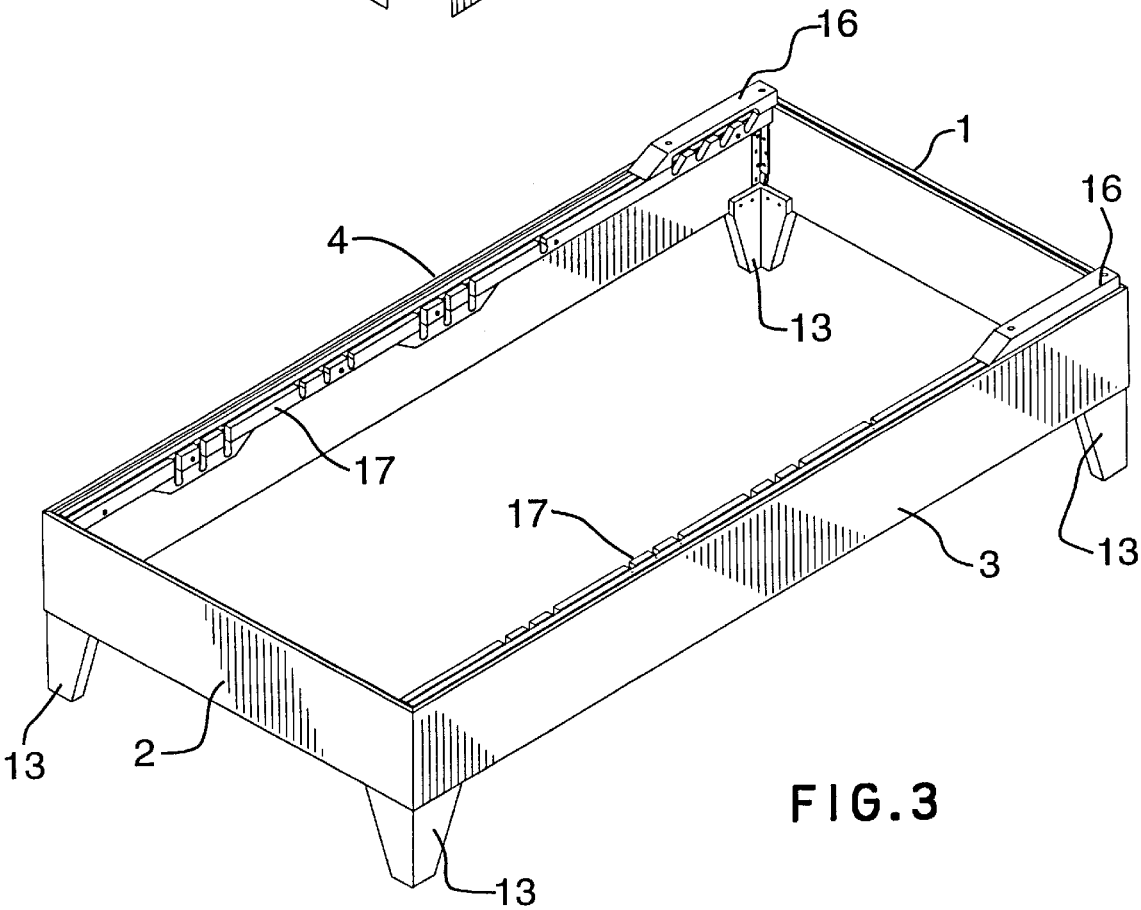
FIG. 3 is a perspective view of the assembled bed frame.
Figure 4:
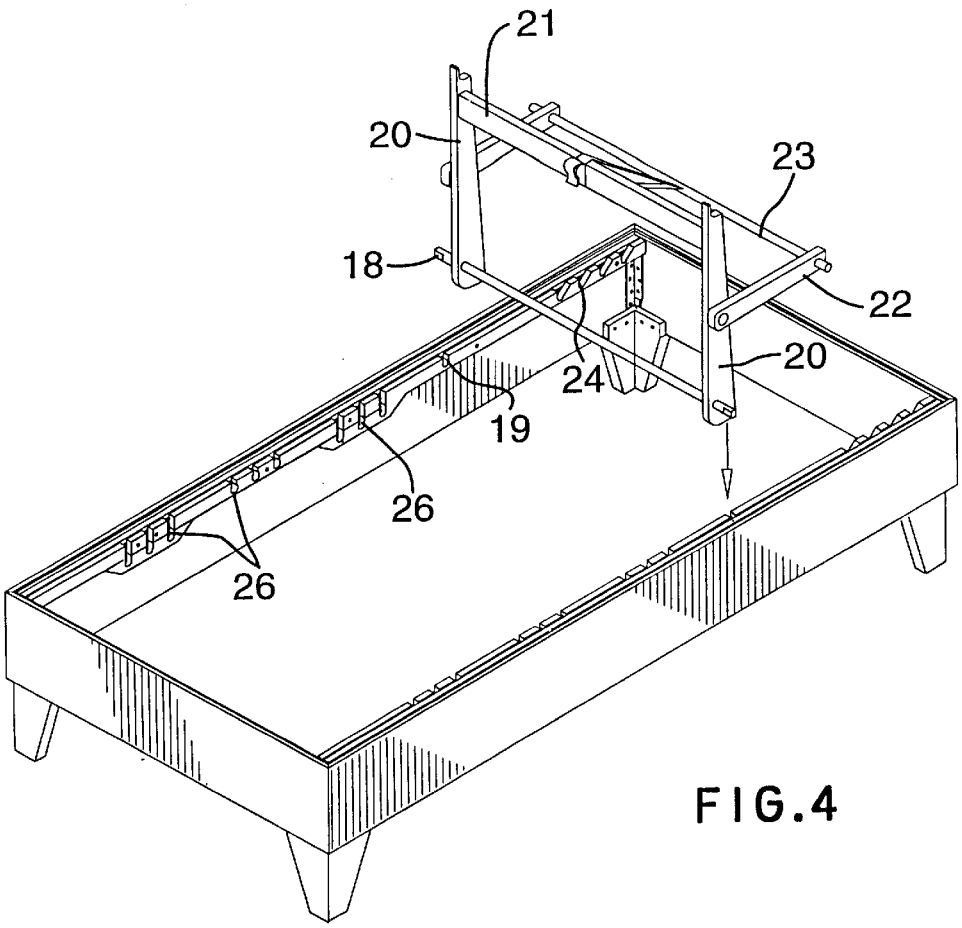
FIG. 4 is a perspective view similar to FIG. 3, but also showing the head elevating mechanism, exploded.

As mentioned above, there are two principal versions of the invention, namely a single bed version, and a version which may be used for double, queen or king size configurations. The single bed version is illustrated in FIGS. 1–15, while the larger version is illustrated in FIGS. 22–31. The single bed version will be described first.

In the single bed version, the bed system has a rectangular frame defined by four vertically-oriented panels, namely a head panel 1, a foot panel 2 and two side panels 3 and 4. A mattress assembly 5 is mounted on the frame, the mattress assembly having an upper wooden strip layer 6, a lower wooden strip layer 7, and intervening foam blocks 8. Each wooden strip layer has a plurality of relatively thin, somewhat flexible laterally-oriented wooden strips 39 arranged in proximity to each other from top to bottom of the frame, with each strip extending from one side panel to the other side panel. There are three of the foam blocks 8, namely two outer foam blocks, one adjacent each side panel and running the length thereof, and one central foam block located centrally between the side panels and running from head to foot of the bed between the wooden strip layers. A padded layer 9, preferably of foam approximately 5 cm thick with a removable 100% cotton cover 10, is positioned on top of the mattress assembly, extending substantially across the full width and length of the mattress assembly. Preferably positioned on top of the padded layer is a sheep's wool mattress pad (not illustrated), also with a cotton cover. Conventional sheets can be used to cover the mattress assembly, padded layer, and mattress pad. A sheep's wool duvet and sheep's wool pillow (also not illustrated) are preferably used to complete the bed system.

Figure 5:
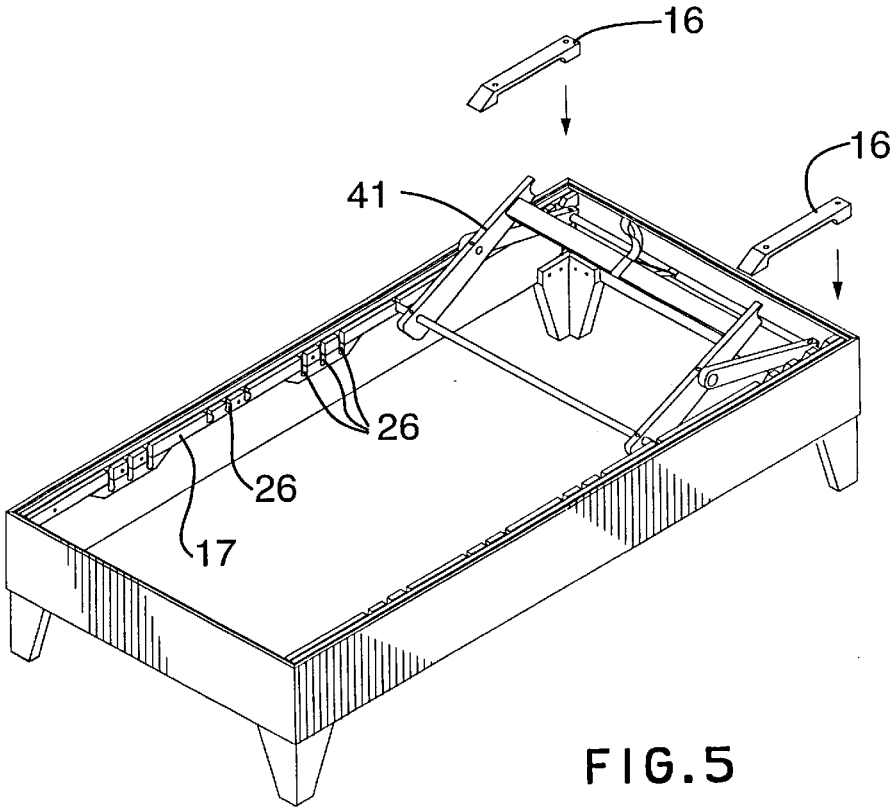
FIG. 5 is a perspective view similar to FIGS. 3 and 4, showing the head elevating mechanism installed.
Figure 6:
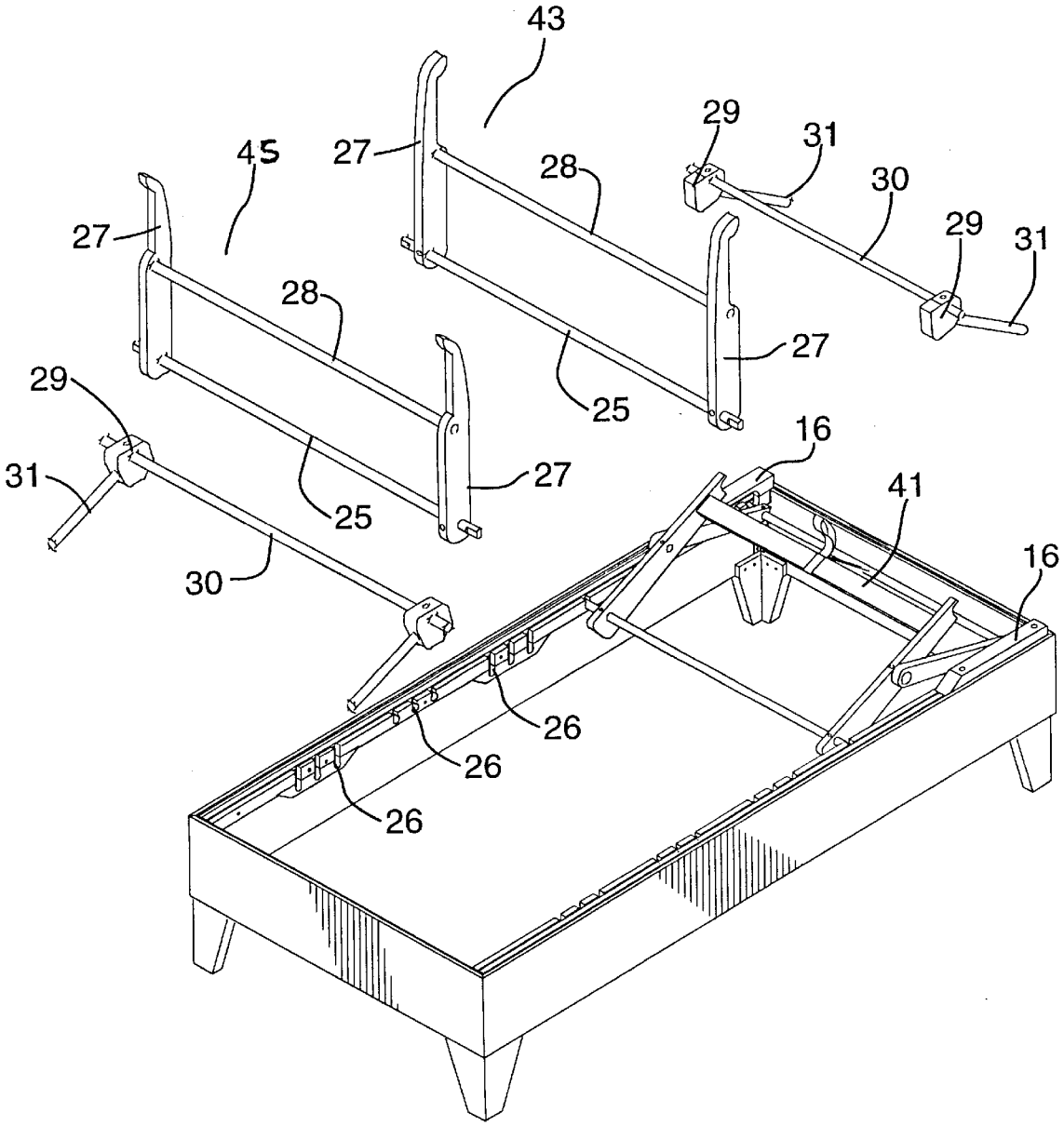
FIG. 6 is another perspective view, also showing the lumbar and leg portion elevating mechanisms.
Figure 7:
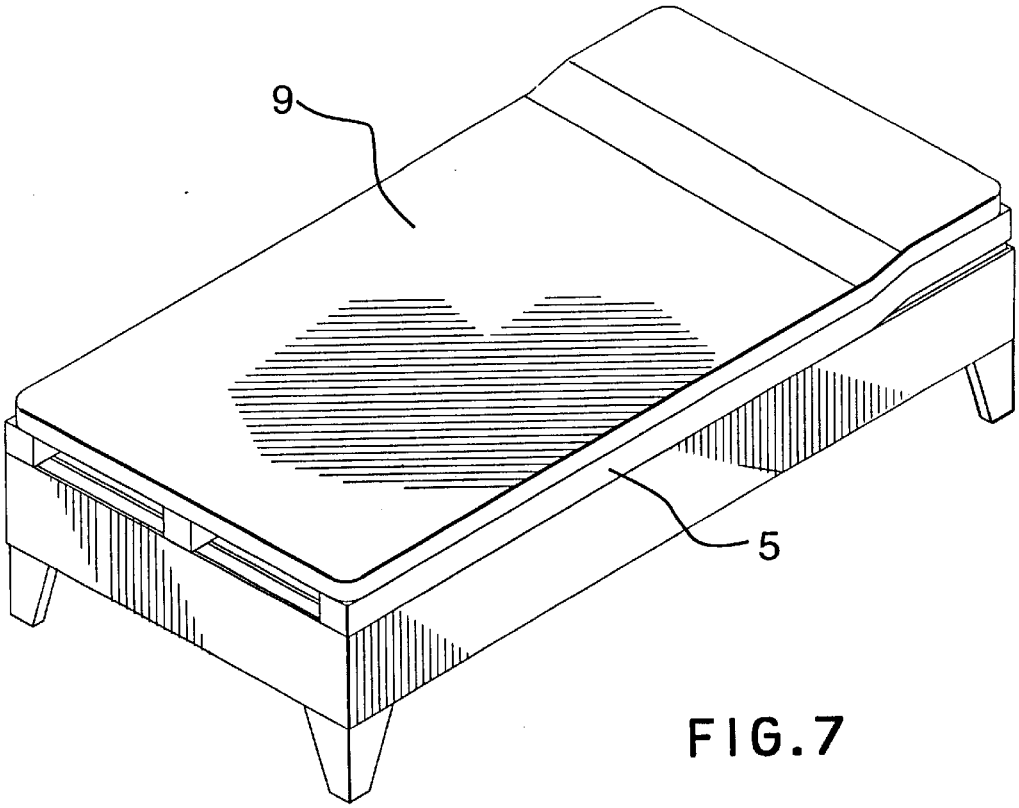
FIG. 7 is a perspective view showing the assembled bed system.
Figure 8:
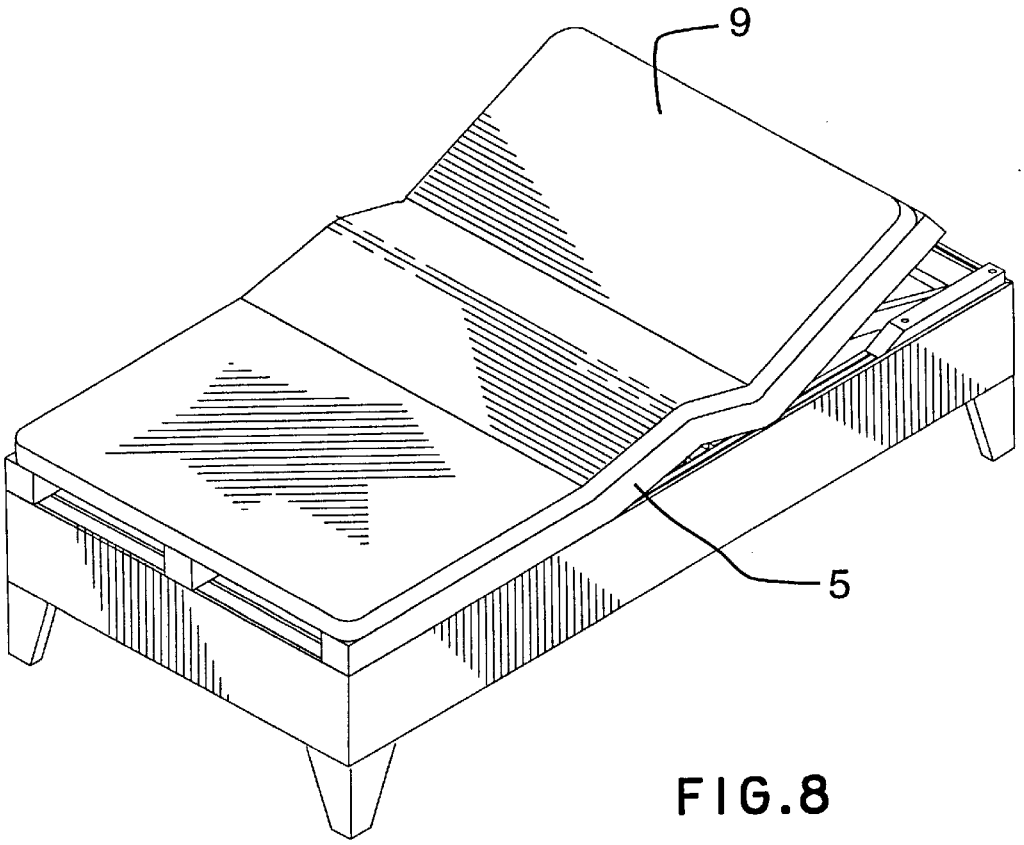
FIG. 8 is a perspective view similar to FIG. 7, showing the head and lumbar portions elevated.
Figure 9:
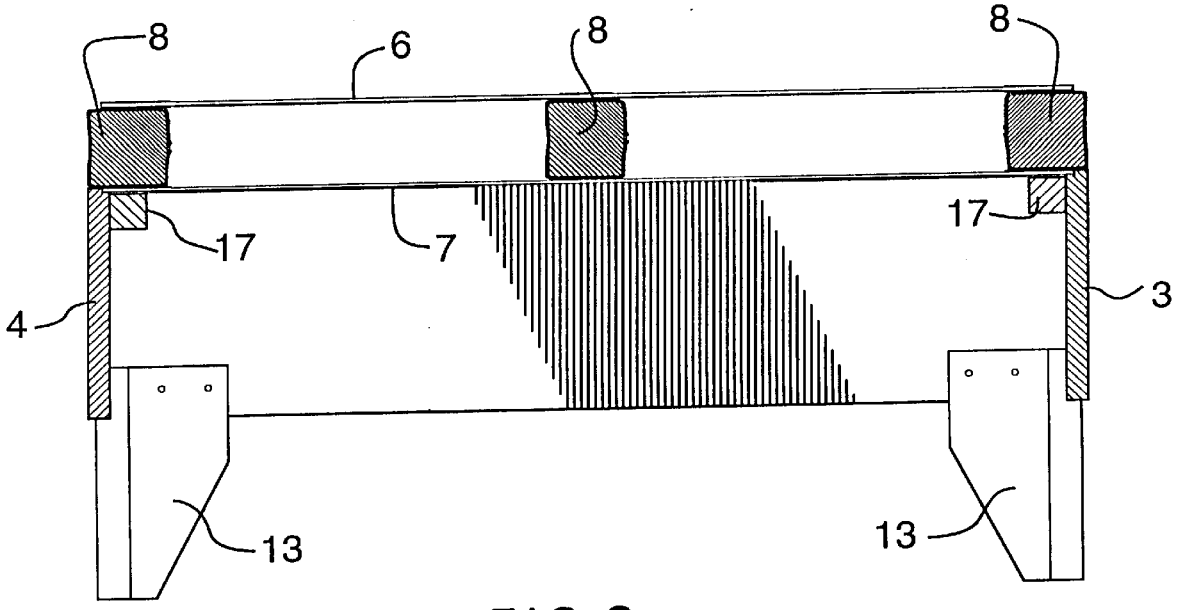
FIG. 9 is a lateral cross-section of the bed system.
Figure 10:
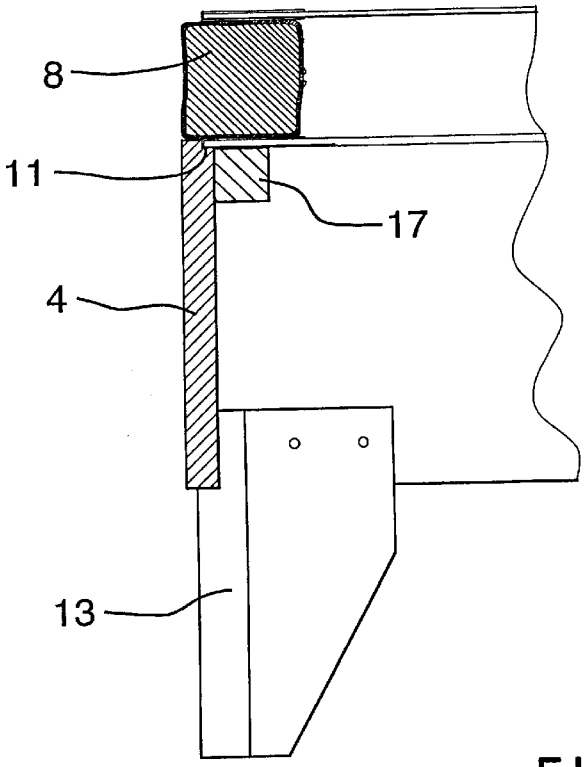
FIG. 10 is a lateral cross-section similar to FIG. 9, but focusing on one corner.
Figure 11:
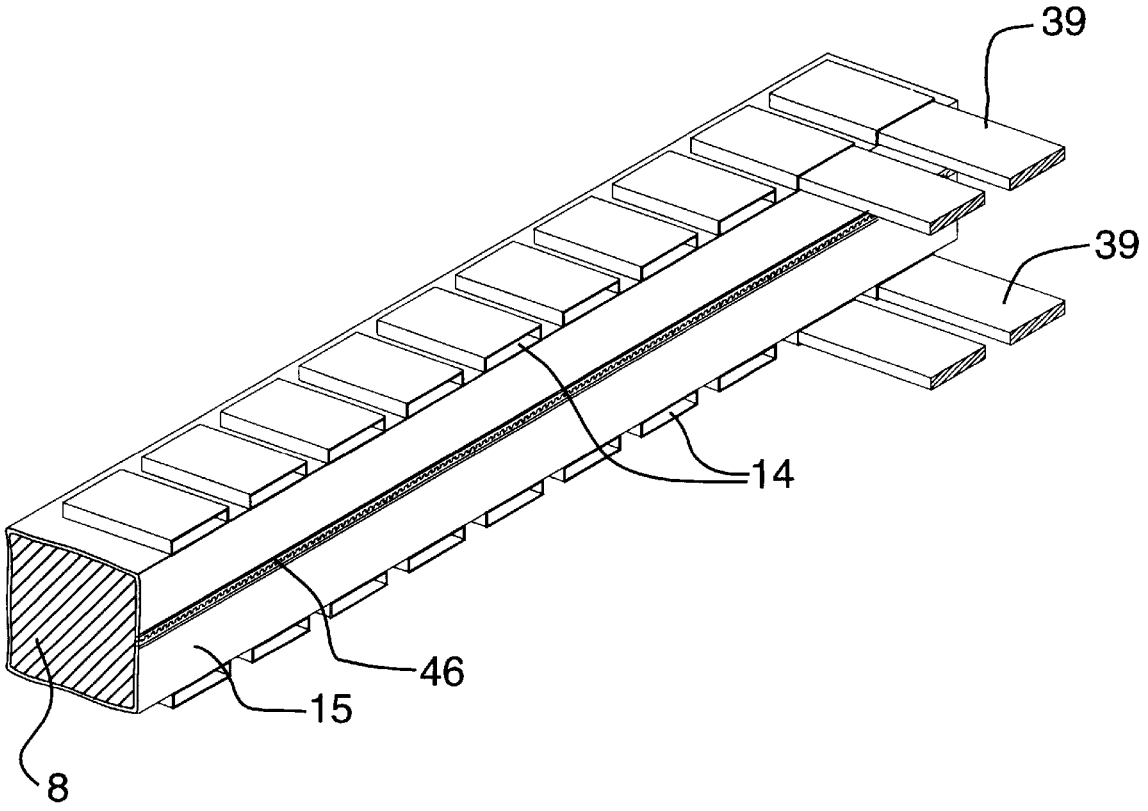
FIG. 11 is a perspective view of one of the foam blocks.
Figure 12:
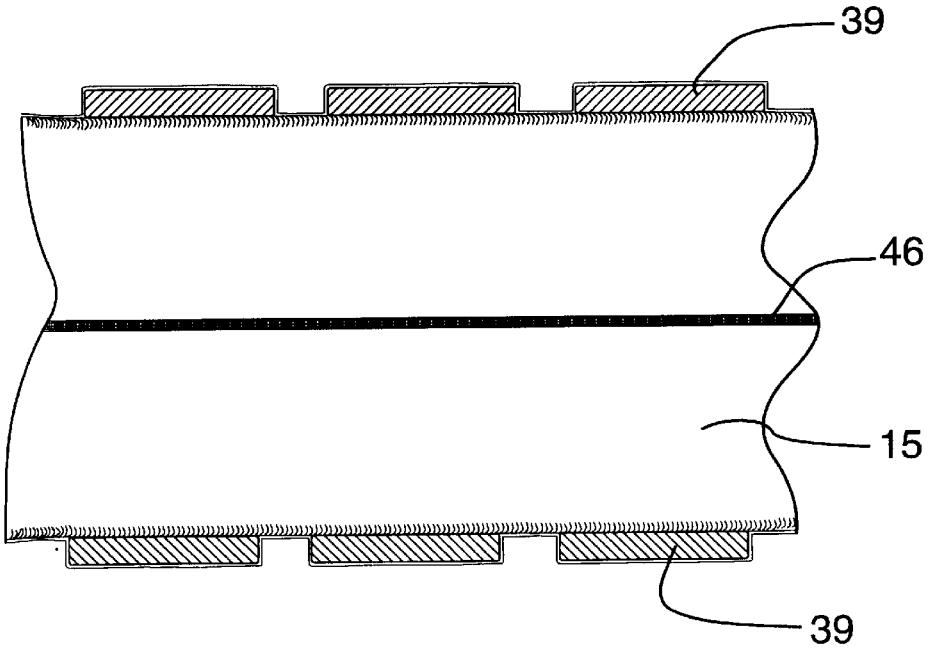
FIG. 12 is a side elevation view of one of the foam blocks.
Figure 13:
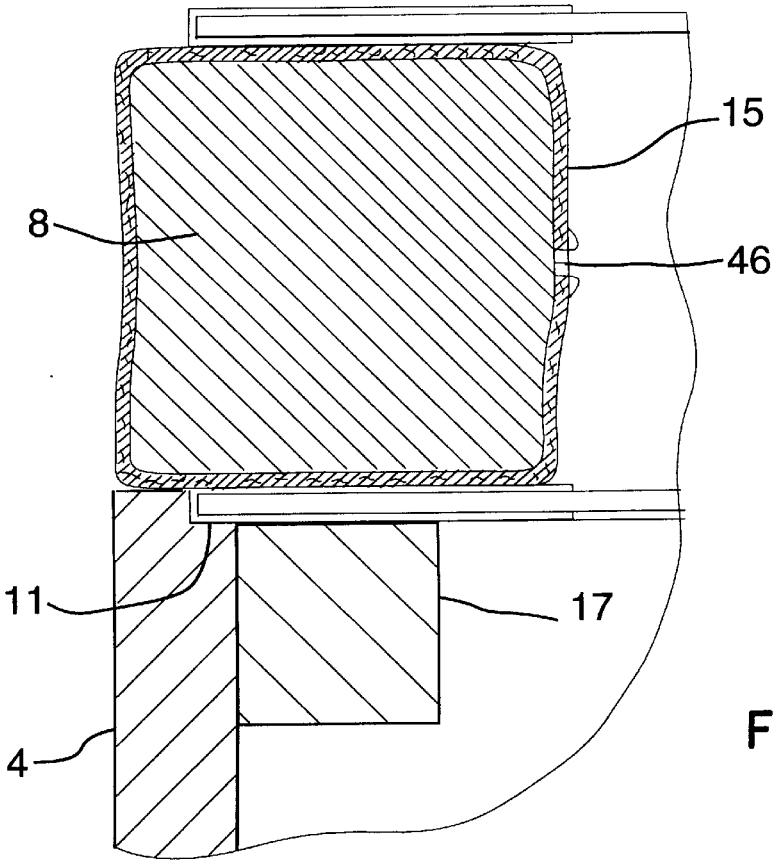
FIG. 13 is a cross-section of one corner of the bed system.
Figure 14:
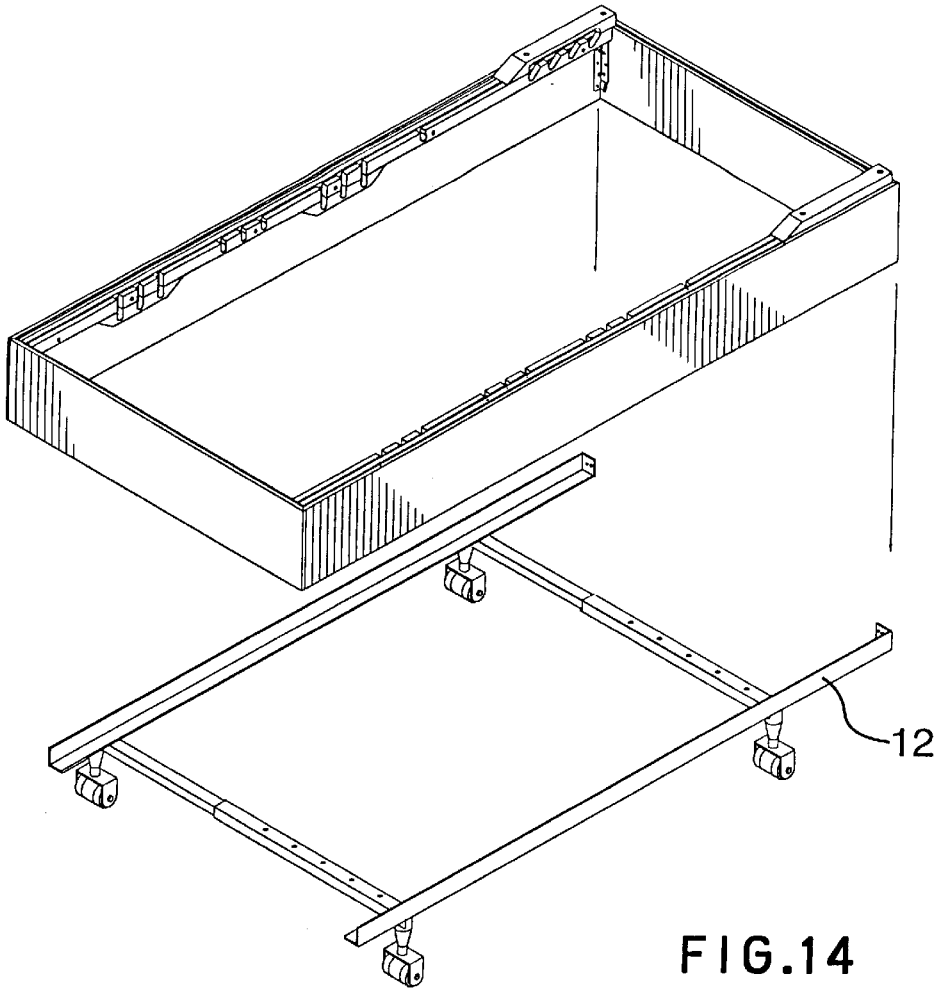
FIG. 14 is an exploded perspective showing how the bed system fits onto a standard bed support.
Figure 15:
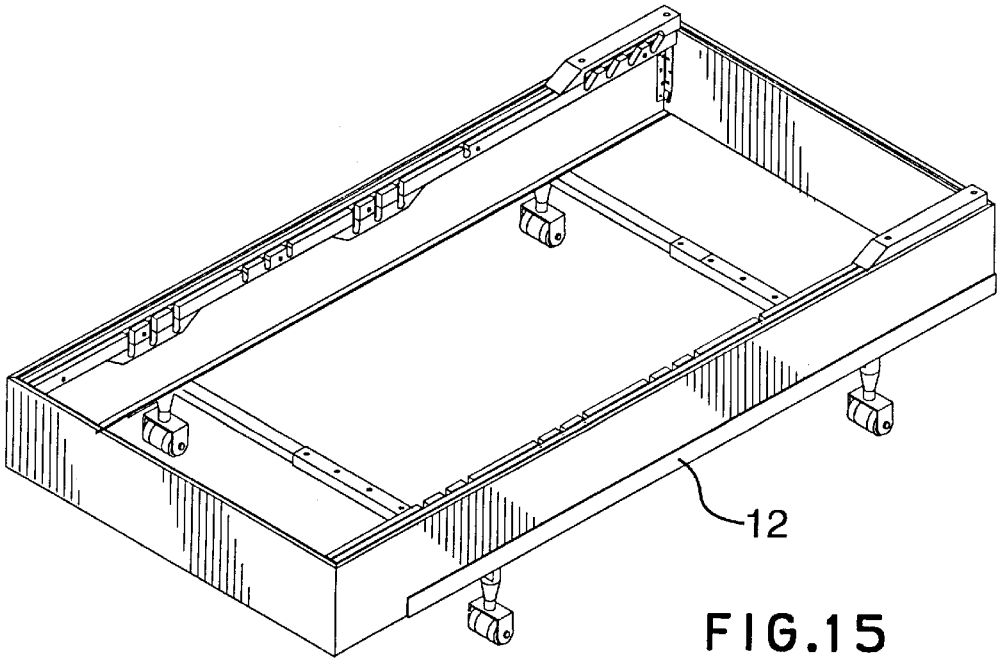
FIG. 15 is a view similar to FIG. 14, showing the frame mounted on the support.

The side panels have inwardly-facing shoulder portions 11 running the length thereof, and the wooden strips of the lower wooden strip layer rest on the shoulder portions, with the outer foam blocks being in general vertical alignment with the outer walls of the side panels. Therefore, when the frame is constructed to fit on a standard bed frame support 12 as shown in FIGS. 14 and 1 5, the bed system conforms generally to standard mattress dimensions for the standard bed frame support, thereby avoiding any need for non-standard sheets and other bedding material. The same is true when the frame is on its own supports, such as legs 13, as shown in FIGS. 9 and 10.

In the preferred embodiment, the outer ends of the wooden strips are positioned in pockets 14 which are provided in material strips along the outer foam blocks. The material strips preferably are provided in material covers 15 which surround the foam blocks. The covers preferably are readily removable by virtue of a zipper 16 running the length of each cover.

Preferably, the mattress assembly is elevated slightly at the head end of the bead, to reduce the need for a thick pillow. This elevation is accomplished by virtue of wedges 16 at the head end of each side frame 3 and 4. The mattress assembly is raised from the shoulder portions 11 by these wedges, although the wedges themselves may be provided with similar shoulder portions if desired, to prevent any lateral shifting of the mattress assembly.

Preferably the bed system includes elevating means pivotally mounted between the side panels, pivotable between lowered positions where the mattress assembly is not elevated above the frame, and at least one elevated position where at least a portion of the mattress assembly is elevated above the frame. This permits the person using the bed to raise the upper portion of the bed towards a sitting position via an upper elevating assembly 41, and/or a portion of the bed in the person's lumbar region via a central elevating assembly 43, and/or a portion of the bed in the area of the person's legs via a lower elevating assembly 45.

In all embodiments of the invention, whether or not including elevating mechanisms, support rails 17 are provided on the inside of each side panel, at the height of the shoulder portions 11, so that the mattress assembly is not supported solely on the shoulder portions. The weight of the mattress assembly and of any person(s) on the bed is borne primarily by the support rails, with the shoulder portions serving primarily to prevent lateral shifting of the mattress assembly.

The mechanism for elevating the head of the bed is shown most clearly in FIGS. 1, 4, 5 and 18. It includes a pivot rod 18 which runs laterally from one side panel to the other, and is lodged in notches 19 in the support rails. Elevation supports 20 extend from the pivot rod towards the head of the bed on either side, and are connected by a crossbar 21. Partway along the elevation supports, braces 22 are pivotally connected. At their distal ends, they are connected by a crosspiece 23. The crosspiece extends between the side panels and can be positioned in any of several notches 24 in the support rails. As can be readily seen from the drawings, different elevations of the head end of the bed can be obtained by selecting different pairs of the notches 24.

The mechanism for elevating the lumbar region is shown most clearly in FIGS. 16–21. It includes a pivot rod 25 which runs laterally from one side panel to the other, and is lodged in any of several notches 26 in the support rails. Elevation supports 27 extend from the pivot rod towards the head of the bed on either side, and are connected by a crossbar 28. Cams 29 are pivotally mounted on the inside of each side panel, under the elevation supports 27, and are connected to each other via a torsion rod 30. A handle 31 is operable to rotate one of the cams, with the other following it by virtue of the torsion rod. Depending on the cam position, as seen in the drawings, different degrees of lumbar elevation are achieved. By selecting different pairs of the notches 26, the location of the lumbar elevation can be varied.

Figure 16:
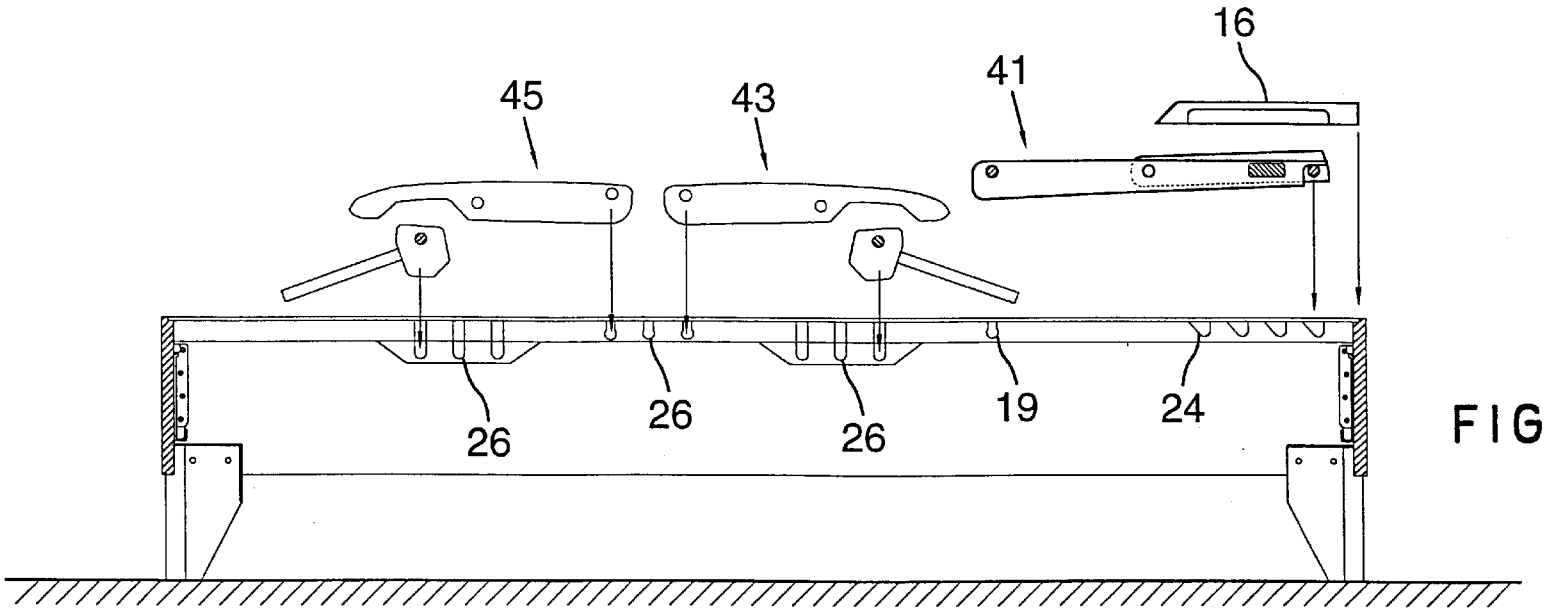
FIGS. 16–21 are side cross-sections showing the various elevating mechanisms in various positions.
Figure 17:
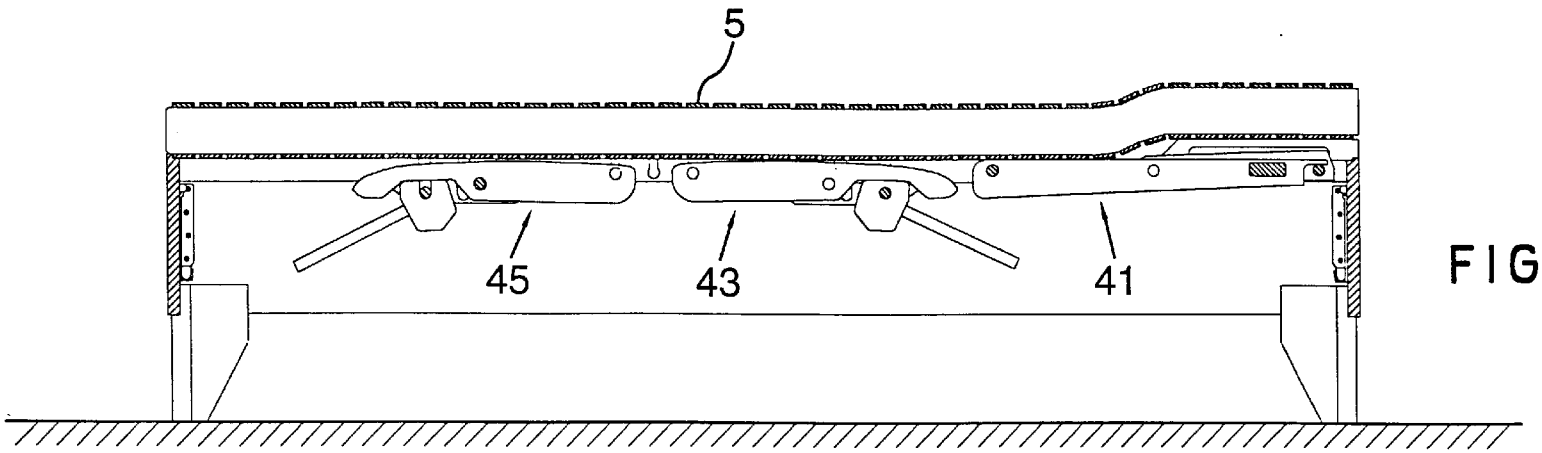
Figure 18:
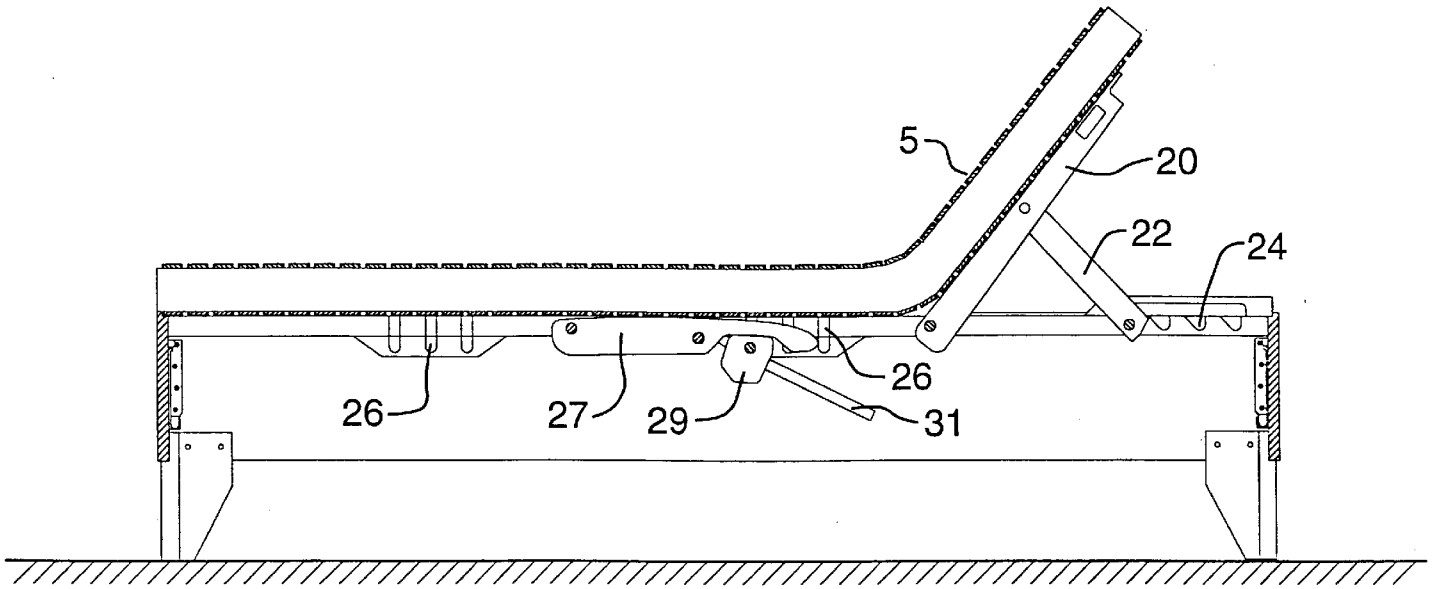
Figure 19:
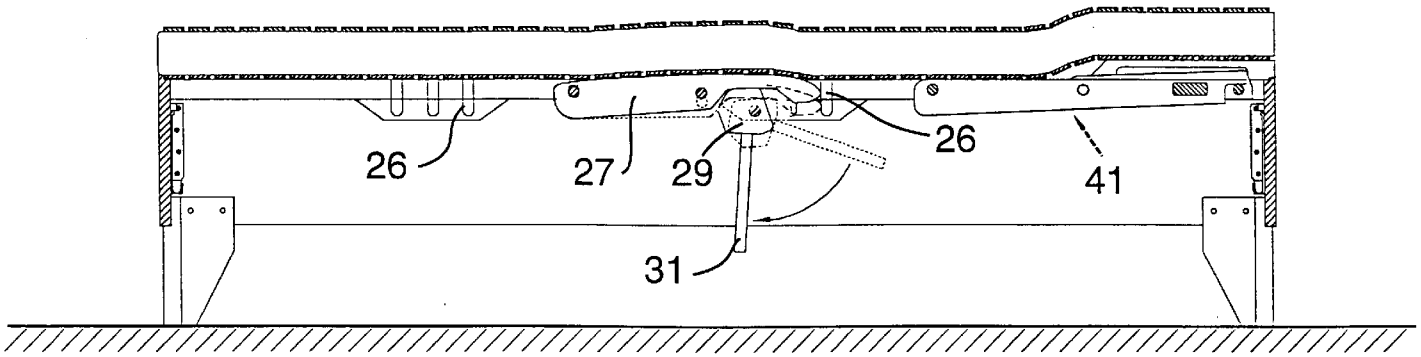
Figure 20:
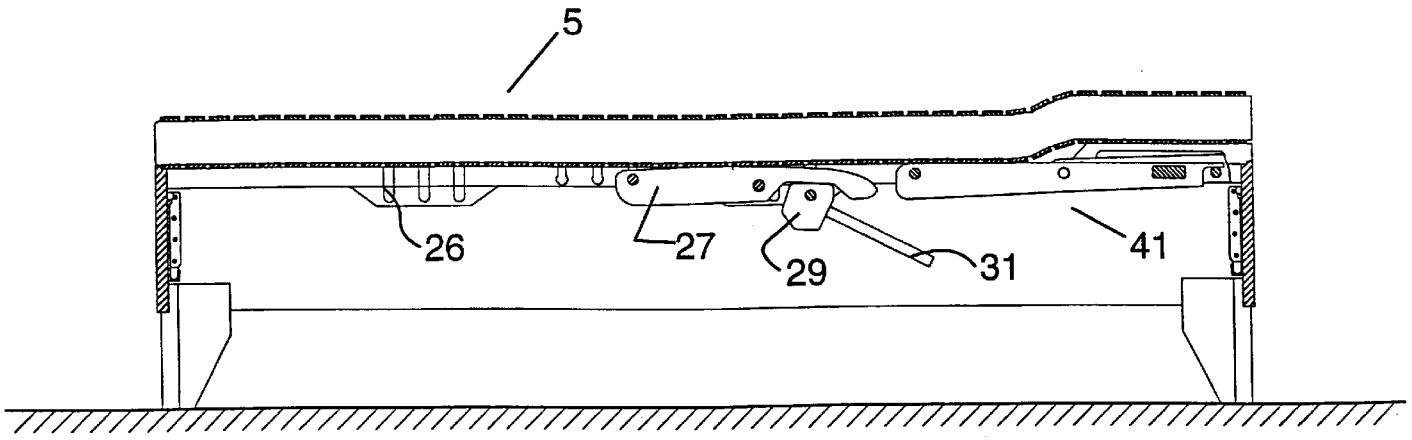
Figure 21:
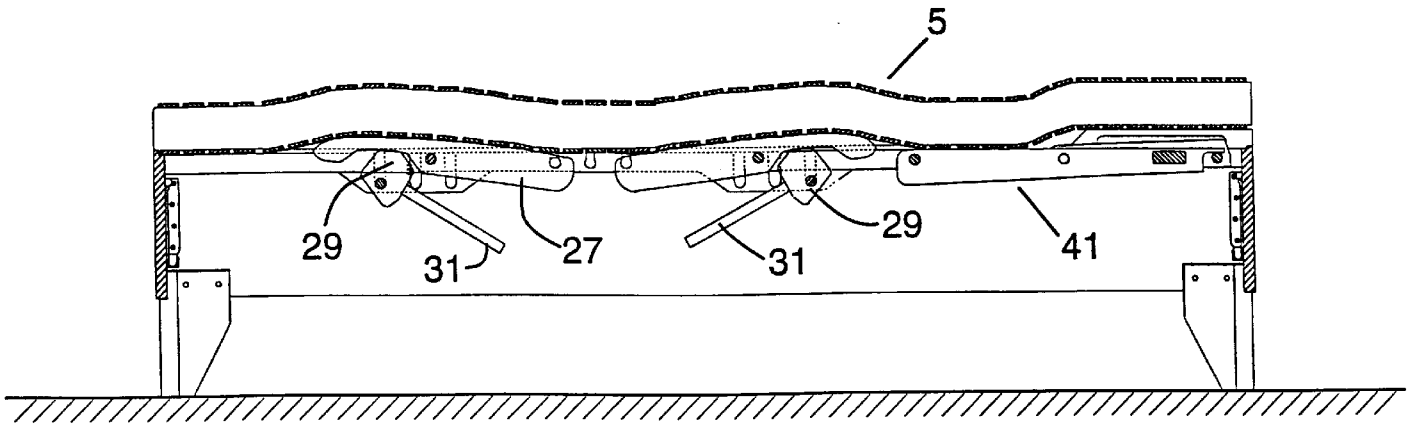
Figure 22:
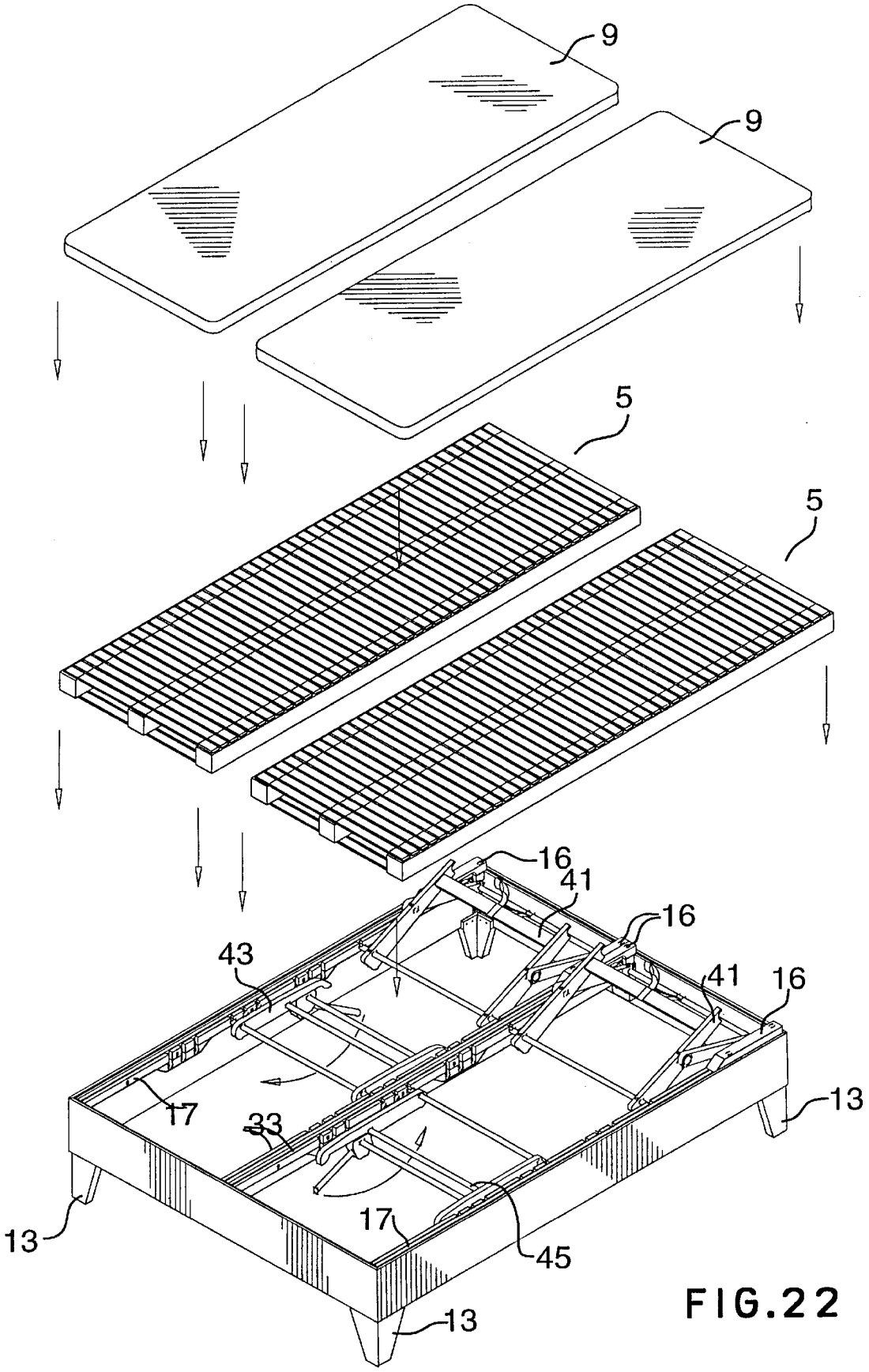
FIG. 22 is an exploded perspective view of a queen-sized bed system.
Figure 23:
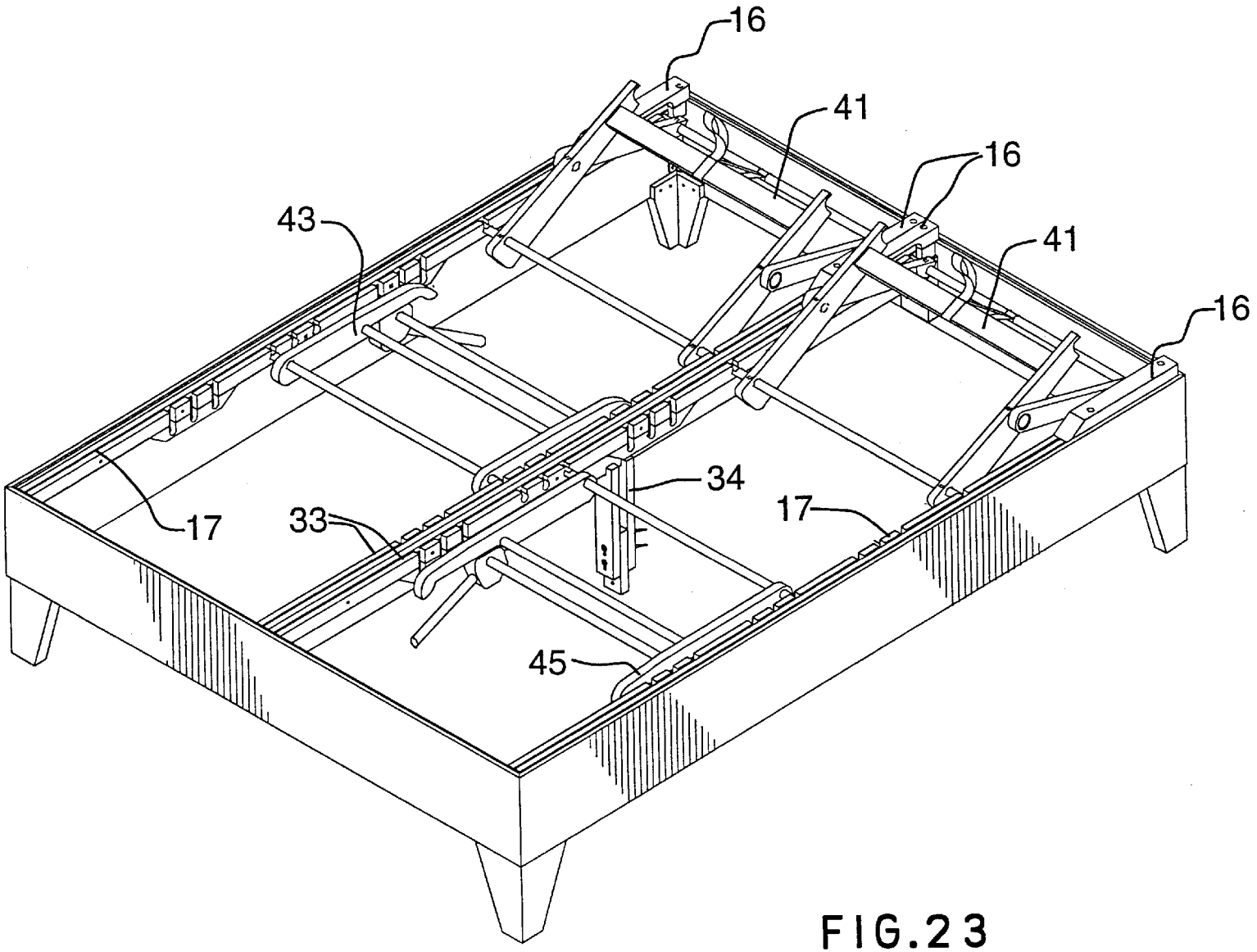
FIG. 23 is a perspective of the bed frame.
Figure 24:
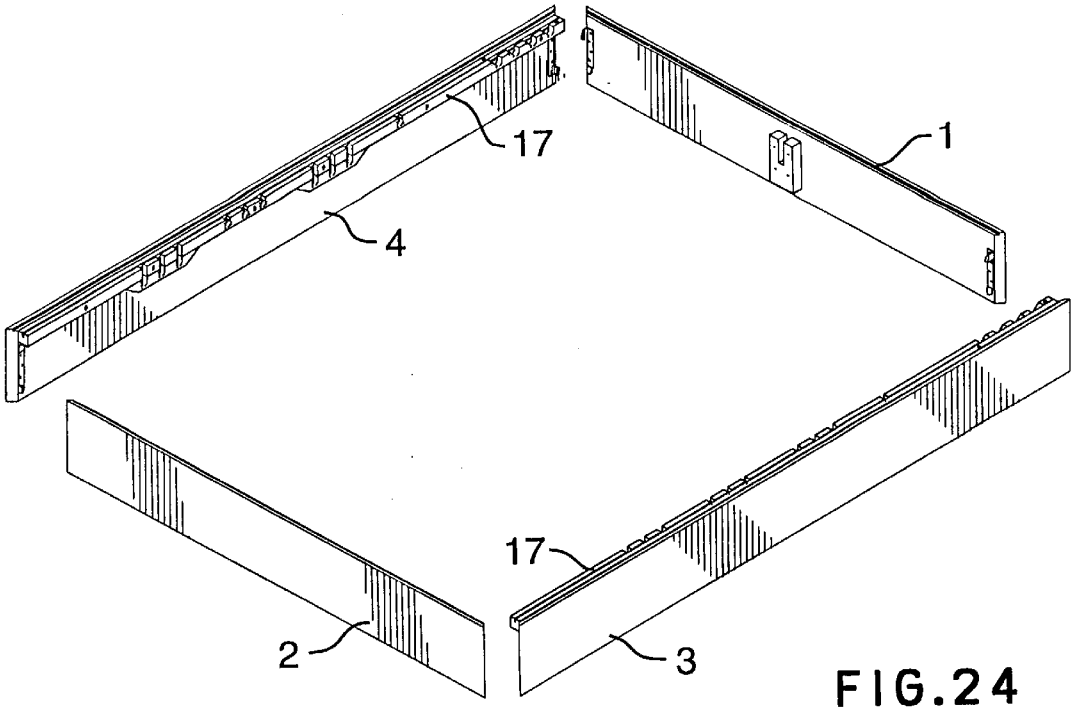
FIG. 24 is a perspective of the bed frame, exploded.
Figure 25:
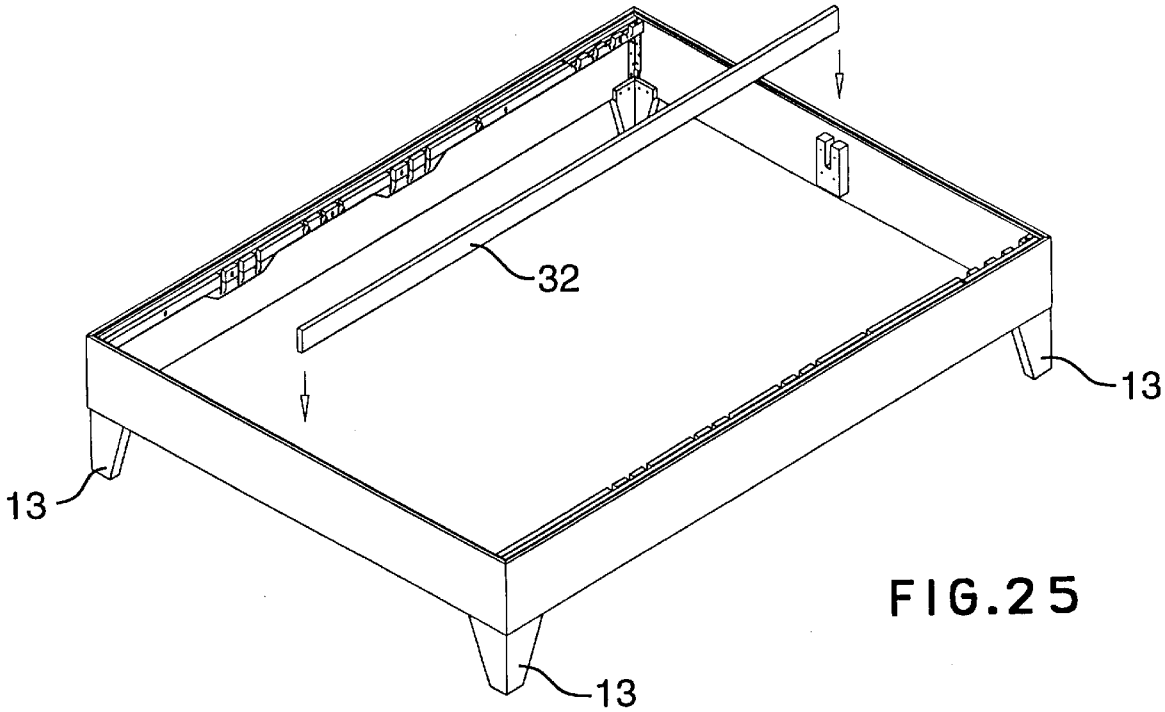
FIG. 25 is another perspective of the bed frame.

As illustrated in FIGS. 16, 17 and 21, an identical mechanism, with its direction reversed, can be employed to provide elevation of an area near the foot of the bed, to provide elevation for the legs. Some of the notches 26 can be used, or additional notches may be provided.

In the double, queen or king sized version of the invention, as seen in FIGS. 22–31, the identical principles are employed, but there is a central support member 32 running longitudinally between the head and foot panels, centrally between the side panels, with an upper surface at the same height as upper surfaces of the side panels. Two of the mattress assemblies are arranged side by side. The central support member has support rails 33 on either side thereof running the length thereof, corresponding to the support rails 17 in the single bed version of the invention, so that the individual mattress assemblies are supported in essentially identical fashion as in the single bed version.

Figure 26:
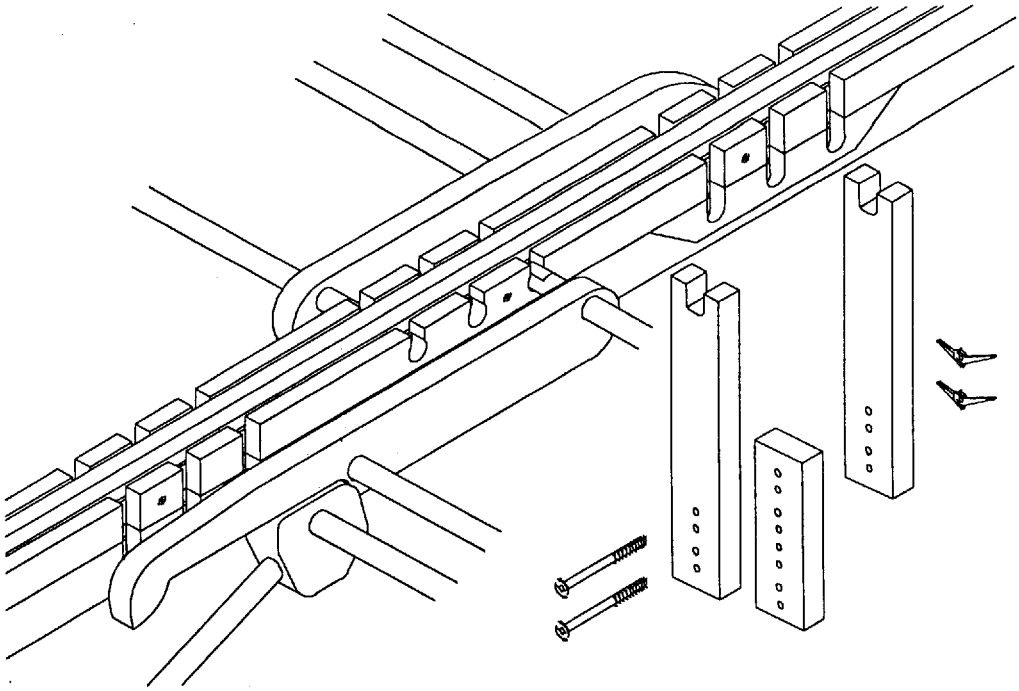
FIG. 26 is a perspective view of the central support member and support post, with the support post exploded.
Figure 27:
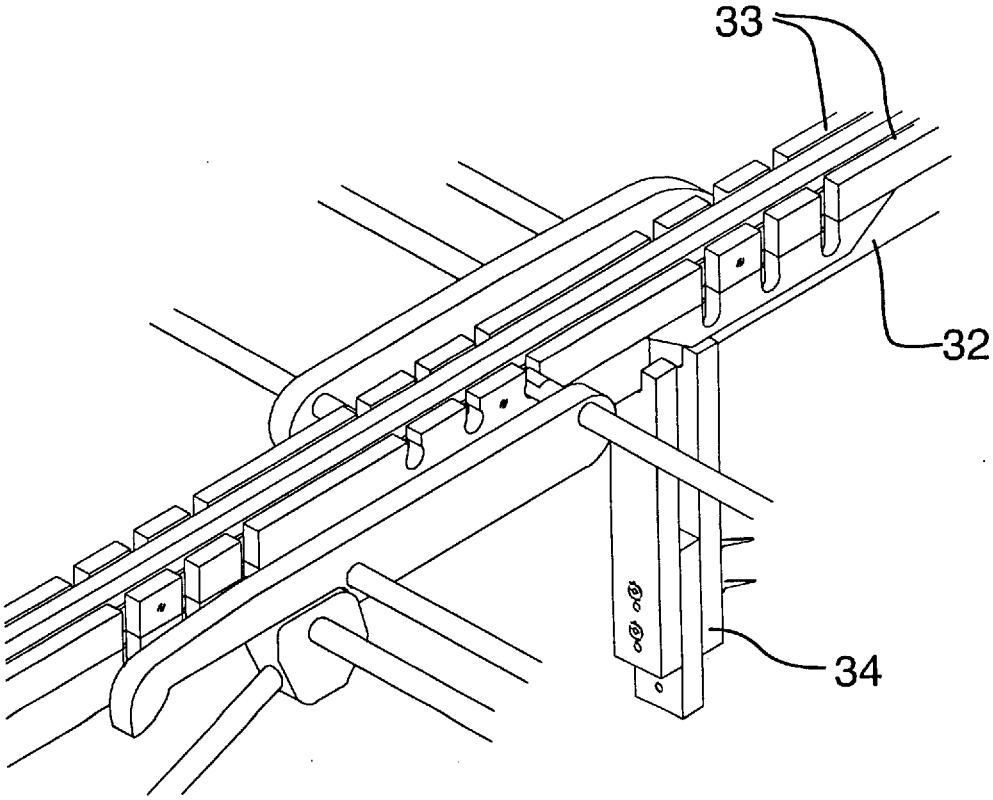
FIG. 27 is a perspective view similar to FIG. 26, with the support post assembled.
Figure 28:
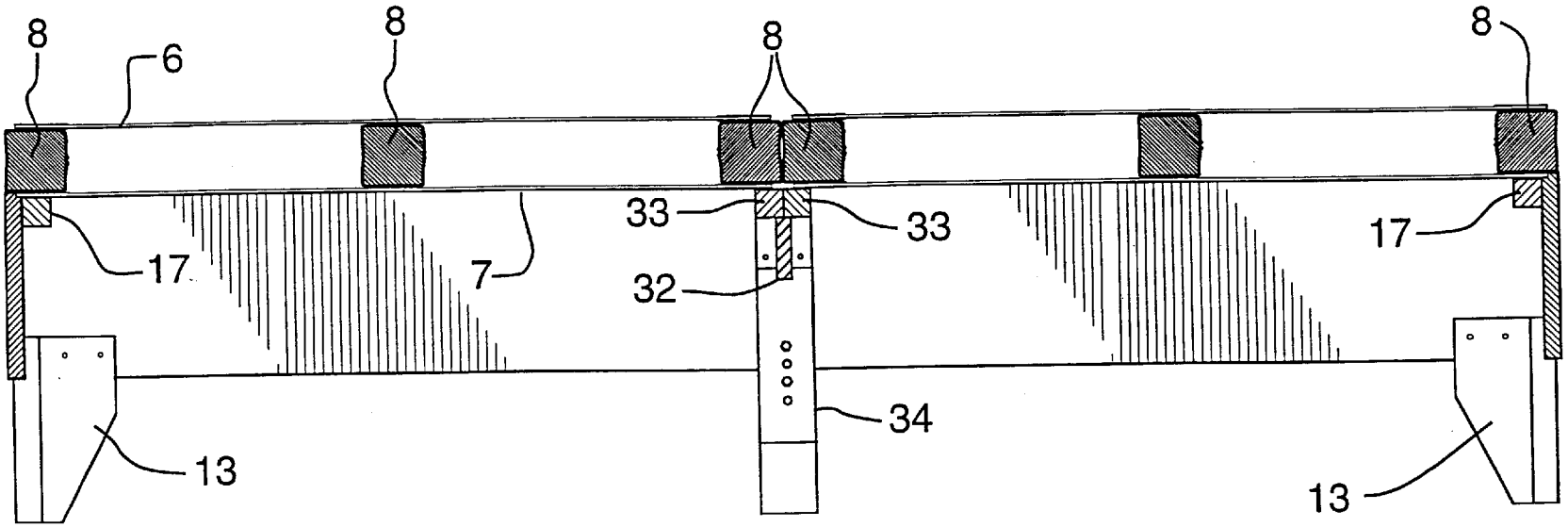
FIG. 28 is a lateral cross-section of the queen-sized bed system.
Figure 29:
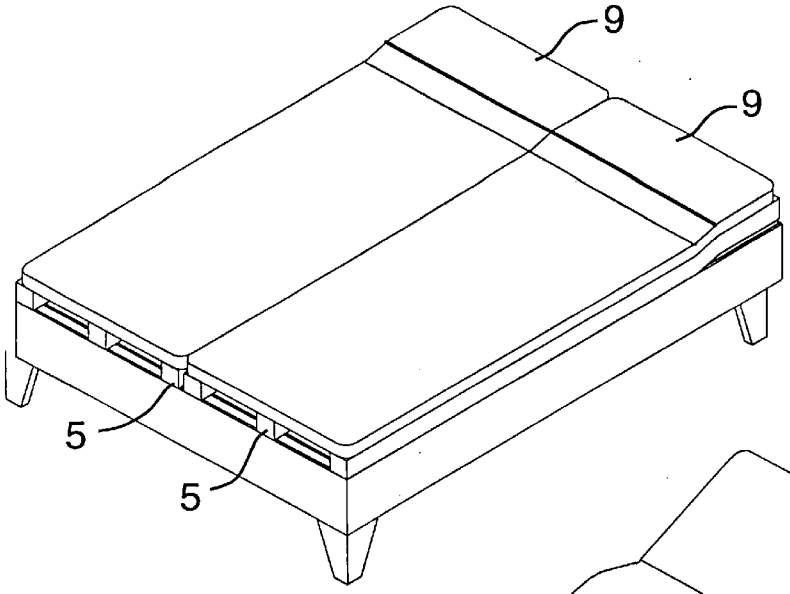
FIGS. 29–31 are perspective views of the assembled queen-sized bed system, in various positions.
Figure 30:
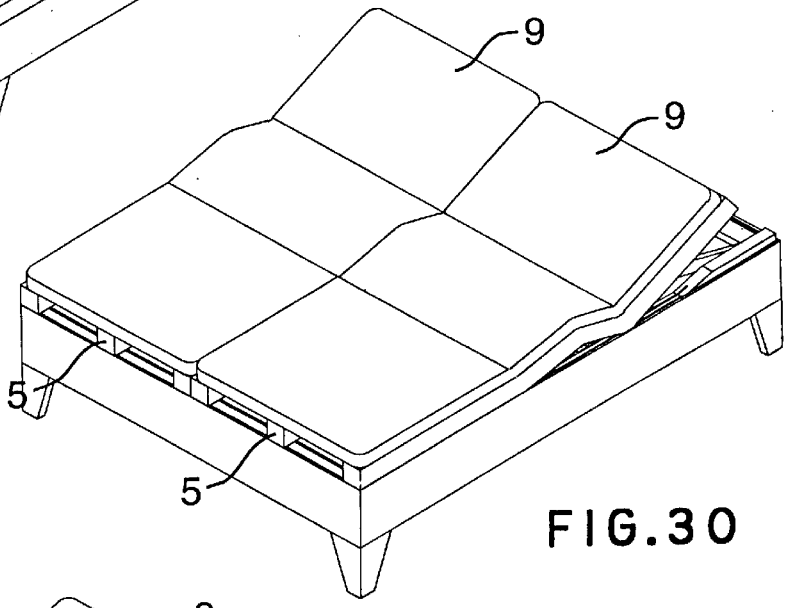
Figure 31:
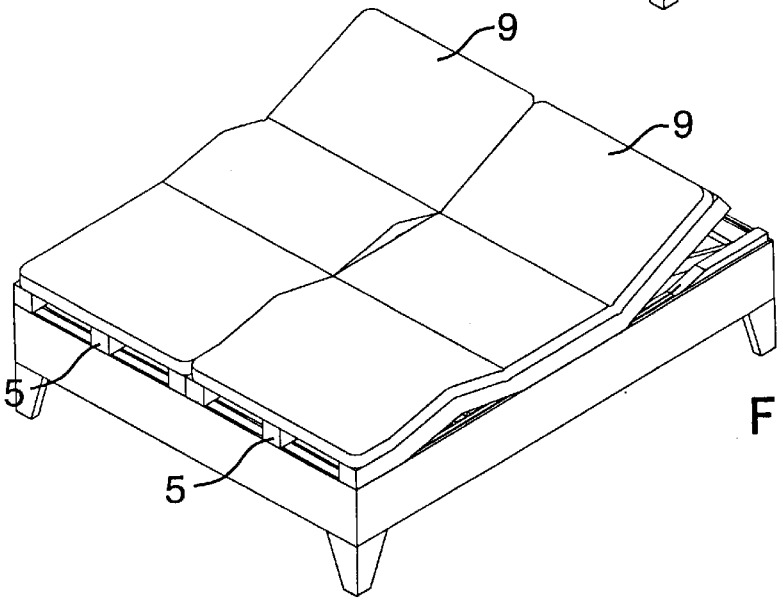

Preferably, the central support member 32 is itself centrally supported by a support post assembly 34, as seen in FIGS. 26, 27 and 28. The height of the support post assembly may be adjusted as desired, by selecting appropriate bolt holes in the various pieces which make up the assembly.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A bed system for a rectangular bed having two sides and head and foot ends, comprising:

a rectangular frame comprising four vertically-oriented panels, namely a head panel, a foot panel and two side panels;

a mattress assembly, said mattress assembly comprising upper and lower wooden strip layers and intervening foam blocks, each said wooden strip layer comprising a plurality of relatively thin, somewhat flexible laterally-oriented wooden strips arranged in proximity to each other from top to bottom of said frame, each strip extending from one side panel to the other side panel, said foam blocks comprising three rectangular elongated longitudinally-oriented blocks, namely two outer foam blocks, one adjacent each side panel and running the length thereof, and one central foam block located centrally between said side panels and running from head to foot of said bed between said wooden strip layers;

a padded layer positioned on top of said mattress assembly, extending substantially across the full width and length of said mattress assembly; where said side panels have inwardly-facing shoulder portions running the length thereof, said wooden strips of said lower wooden strip layer resting on said shoulder portions, said outer foam blocks being in general vertical alignment with outer walls of said side panels, whereby, when said frame is constructed to fit on a standard bed frame support, said bed system conforms generally to standard mattress dimensions for said standard bed frame support, thereby avoiding any need for non-standard sheets and other bedding material.

2. A bed system as recited in claim 1, where outer ends of said wooden strips are positioned in pockets provided in material strips along said outer foam blocks, and where said wooden strips pass through corresponding channels in material strips along said central foam block.

3. A bed system as recited in claim 2, where said pockets and channels are provided in material covers which surround said foam blocks.

4. A bed system as recited in claim 1, where said padded layer is a layer of foam material.

5. A bed system as recited in claim 4, where said wooden strip layers are approximately 9 cm apart, by virtue of said foam blocks being approximately 9 cm in height, and where said layer of foam material is approximately 5 cm thick.

6. A bed system as recited in claim 1, further comprising mattress assembly elevating means pivotally mounted between said side panels, pivotable between lowered positions where said mattress assembly is not elevated above said frame, and at least one elevated position where at least a portion of said mattress assembly is elevated above said frame.

7. A bed system as recited in claim 6, where said mattress assembly elevating means comprises at least one of: (a) an upper elevating assembly to raise the upper portion of the bed towards a sitting position; (b) a central elevating assembly to raise a portion of the bed in the person's lumbar region; and (c) a lower elevating assembly to raise a portion of the bed in the area of the person's legs.

8. A bed system for a rectangular bed having two sides and head and foot ends, comprising:

a rectangular frame comprising four vertically-oriented panels, namely a head panel, a foot panel and two side panels;

a central support member running longitudinally between said head and foot panels, centrally between said side panels, with an upper surface at the same height as upper surfaces of said side panels;

two mattress assemblies arranged side by side, each said mattress assembly comprising upper and lower wooden strip layers and intervening foam blocks, each said wooden strip layer comprising a plurality of relatively thin, somewhat flexible laterally-oriented wooden strips arranged in proximity to each other from top to bottom of said frame, each strip extending from one side panel to said central support member, said foam blocks comprising three rectangular elongated longitudinally-oriented blocks, namely two outer foam blocks, one adjacent a side panel and the other adjacent said central support member, and one central foam block located centrally between said side panel and said central support member, each of said foam blocks running from head to foot of said bed between said wooden strip layers;

a padded layer positioned on top of each said mattress assembly, extending substantially across the full width and length of said mattress assembly; where said side panels have inwardly-facing shoulder portions running the length thereof, and said central support member has support rails on either side thereof running the length thereof, said wooden strips of each said lower wooden strip layer resting on shoulder portions, said outer foam blocks being in general vertical alignment with outer walls of said side panels or with a centerline of said central support member as the case may be, whereby, when said frame is constructed to fit on a standard bed frame support, said bed system conforms generally to standard mattress dimensions for said standard bed frame support, and there is substantially no gap between adjacent mattress assemblies, thereby avoiding any need for non-standard sheets and other bedding material.

9. A bed system as recited in claims 8, where outer ends of said wooden strips are positioned in pockets provided in material strips along each of said outer foam blocks, and where said wooden strips pass through corresponding channels in material strips along said central foam block.

10. A bed system as recited in claim 9, where said pockets and channels are provided in material covers which surround each of said foam blocks.

11. A bed system as recited in claims 8, where each said padded layer is a layer of foam material.

12. A bed system as recited in claim 11, where said wooden strip layers are approximately 9 cm apart, by virtue of said foam blocks being approximately 9 cm in height, and where said layer of foam material is approximately 5 cm thick.

13. A bed system as recited in claim 8, further comprising mattress assembly elevating means pivotally mounted on each mattress assembly between said side panels and said central support member, pivotable between lowered positions where said mattress assembly is not elevated above said frame, and at least one elevated position where at least a portion of said mattress assembly is elevated above said frame.

14. A bed system as recited in claim 13, where said mattress assembly elevating means comprises, for each mattress assembly, at least one of: (a) an upper elevating assembly to raise the upper portion of the bed towards a sitting position; (b) a central elevating assembly to raise a portion of the bed in the person's lumbar region; and (c) a lower elevating assembly to raise a portion of the bed in the area of the person's legs.

* * * * *